United States Patent [19]

Takamatsu

[11] 3,955,247

[45] May 11, 1976

[54] SLIDE FASTENER ELEMENT CONSTRUCTION

[75] Inventor: Ikuo Takamatsu, Uozu, Japan

[73] Assignee: Yoshida Kogyo Kabushiki Kaisha, Japan

[22] Filed: Dec. 27, 1974

[21] Appl. No.: 536,804

[30] Foreign Application Priority Data

Dec. 29, 1973 Japan ..... 49-3168[U]

[52] U.S. Cl. ..... 24/205.13 D

[51] Int. Cl.[2] ..... A44B 19/14

[58] Field of Search ..... 24/205.13 D

[56] References Cited

UNITED STATES PATENTS

| | | | |
|---|---|---|---|
| 2,876,519 | 3/1959 | Dittmayer | 24/205.13 D |
| 3,414,948 | 12/1968 | Cuckson | 24/205.13 D |
| 3,704,490 | 12/1972 | Hansen | 24/205.13 D |

FOREIGN PATENTS OR APPLICATIONS

| | | | |
|---|---|---|---|
| 1,285,599 | 1/1962 | France | 24/205.13 D |
| 224,580 | 10/1959 | Australia | 24/205.13 D |
| 541,786 | 12/1941 | United Kingdom | 24/205.13 D |
| 871,455 | 6/1961 | United Kingdom | 24/205.13 D |
| 871,458 | 6/1961 | United Kingdom | 24/205.13 D |
| 408,797 | 1/1945 | Italy | 24/205.13 D |

*Primary Examiner*—Bernard A. Gelak
*Attorney, Agent, or Firm*—Bucknam and Archer

[57] ABSTRACT

A slide fastener element construction having a ladder-like structure of the type which is longitudinally folded on itself to form a finished row of coupling elements. The ladder-like structure basically includes longitudinally parallel spaced-apart base portions, a plurality of pairs of element-forming members projecting in opposed relation inwardly from the base portions, enlarged coupling head portions integral with the element-forming members and located innermost of the structure and bridge portions extending transversely of the structure for connecting the pairs of element-forming members.

6 Claims, 5 Drawing Figures

SLIDE FASTENER ELEMENT CONSTRUCTION

BACKGROUND OF THE INVENTION

This invention relates generally to slide fasteners and more particularly to a row of coupling fastener elements therefor. In the manufacture of slide fasteners, there are known various forms of coupling elements, one example of such elements having a ladder-like structure which, when attached to a stringer tape, is folded longitudinally on itself into a cross-sectionally U-shaped configuration. The coupling head portions of the elements known in the art are formed of a solid piece such that they are deficient in resiliency and hence are difficult to come smoothly into and out of mutual engagement.

SUMMARY OF THE INVENTION

It is therefore the principal object of this invention to provide a row of slide fastener coupling elements having a ladder-like structure which will eliminate the abovestated drawback of the prior art.

A more specific object of the invention is to provide an improved fastener element construction which ensures smooth and accurate engagement of the individual coupling elements on respective mating stringer tapes and further retains the elements that have been interengaged against accidental separation which would otherwise take place when the fastener is subjected to severe external stresses.

Other objects and attendant advantages of the present invention will become apparent after reading the following specification and inspecting the accompanying drawings.

DESCRIPTION OF THE PREFERRED EMBODIMENT

Figure 1:
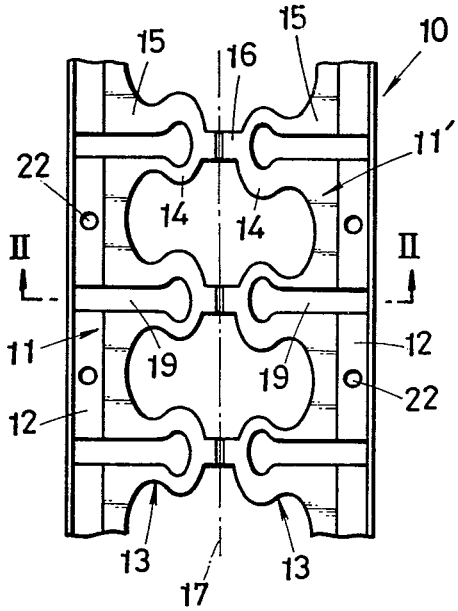
FIG. 1 is a plan view of a ladder-like structure from which a row of slide fastener coupling elements is formed in accordance with this invention.

Referring now to the drawings and FIG. 1 in particular, there is shown a starting ladder-like structure generally designated by 10 embodying the concept of this invention, which structure is formed for example by punching or injection-molding a thermoplastic synthetic resin or similar pliable material and from which structure is formed subsequently a row of coupling elements. The ladder-like structure 10 includes parallel base portions 11 and 11' extending longitudinally of and at the outer sides of the structure. The base portions 11 and 11' are each provided with an elongate groove 12 extending the full length of the structure 10. A plurality of pairs of elementforming members 13 identical in all respects are formed in the structure 10 which project in opposed relation inwardly of the respective base portions 11 and 11'.

As shown in FIG. 1, each element forming member 13 has an innermost portion 14 enlarged and projecting laterally thereof or in the longitudinal direction of the structure 10 and a foot portion 15 flaring outwardly of the member 13. An inspection of FIG. 1 shows that the pairs of element-forming members 13 in the respective rows are each connected by a bridge 16 formed integrally with the enlarged portions 14 which function as coupling heads and have their respective center axes slightly displaced relative to each other in the longitudinal direction of the structure 10.

Figure 2:
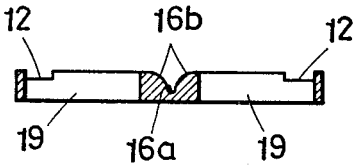
FIG. 2 is a cross-sectional view taken along the line II—II of FIG. 1.
Figure 3:
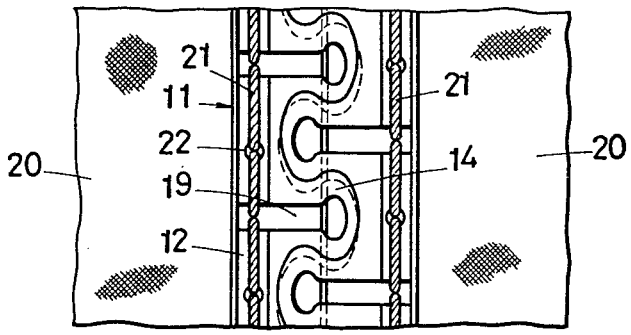
FIG. 3 is a plan view of a pair of slide fastener stringers each having mounted thereon a row of finished fastener elements and shown coupled together.
Figure 4:
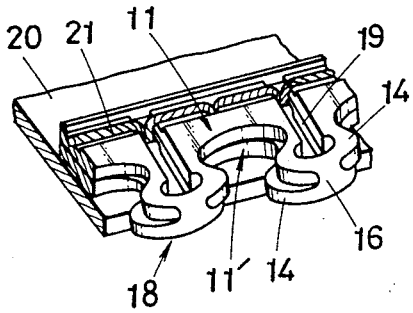
FIG. 4 is a fragmentary perspective view of the row of coupling elements shown secured onto one side of the stringer tape along a longitudinal edge thereof.
Figure 5:
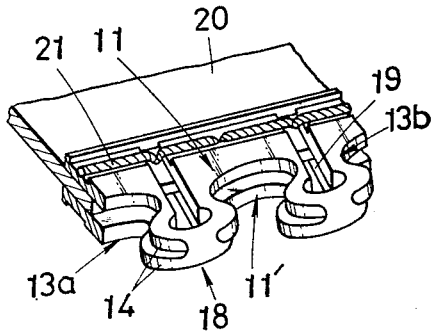
FIG. 5 is a view similar to FIG. 4 but illustrating the row of elements mounted astride of the tape along a longitudinal edge thereof.

In order to facilitate the bending or folding of the structure 10 hereafter described, there is provided a cutout recess **16*a* in the center of the bridge 16 of each pair of element-forming members 13, which recess defines an axis of fold about which the structure 10 is folded on itself. The recess 16*a* is flared outwardly, as viewed in FIG. 2, so as to provide a rounded corner 16*b* on each side of the recess 16*a*, the arrangement being that the coupling head 14 of the elementforming member 13 in its finished form has a rounded peripheral contour such that the coupling and uncoupling operation of the fastener can be carried out most smoothly. The ladder-like structure 10 is folded on itself about its longitudinal center axis 17, whereupon the two opposed element-forming members 13 are superimposed upon each other as seen in FIGS. 4 and 5. Due to displaced center axes of the opposed element-forming members, however, the lower layer 13*a* of members 13 protrudes slightly beyond one side of the upper layer 13*b* of members 13 when seen in projection to the plane of the fastener. This arrangement provides stable engagement of the two rows of elements 18** and retains them in properly coupled condition against stresses applied in any direction.

In accordance with the features of the invention, there is provided an elongated slot 19 formed in each individual element-forming member 13 and extending transversely of the ladder-like structure 10. The slot 19 extends from an inner edge of the groove 12 into the region of coupling head portion 14 where it becomes enlarged to a contour conforming to the coupling head 14. The provision of these slots 19 is intended to render the elements 18 resilient and hence allow them to yield to the forces exerted when they are coupled together, thus achieving flexible and smooth engagement of the opposed stringers of the fastener.

It is to be noted that although the element-forming members 13 in each pair are axially displaced as previously stated, the slots 19 in each pair of members 13 are aligned in complete registration so that each of the resulting elements 18 has a symmetric profile. This will provide well balanced element-to-element coupling condition. The row of fastener elements 18 of the foregoing construction may be mounted on and secured to one side or surface of a carrier tape 20 along a longitudinal edge thereof, as shown in FIG. 4, by means of adhesive bonding, welding, supersonic or high-frequency heating and/or sewing operation in the manner well known in the art. Since the row of elements 18 is a folded structure, it may be mounted on the tape 20 with separated base portions 11, 11' disposed astride of the tape edge as shown in FIG. 5. The elements 18 may be secured to the tape 20 with use of sewn stitches 21, for which purpose there are provided at suitable intervals longitudinally aligned apertures 22 in the grooved portion 12 of the structure 10 which is located remote from the coupling heads 14.

What is claimed is:

1. A slide fastener element construction which is formed from a pliable material substantially into a ladder-like structure, said structure comprising parallel base portions extending longitudinally of and at the outer sides of the structure, a plurality of pairs of element-forming members projecting in opposed relation inwardly of the respective base portions, enlarged coupling head portions integral with said element-forming members and located innermost of said structure and bridge portions extending transversely of said structure and adapted to connect the pairs of element-forming members, said structure being folded longitudinally on itself about said bridge portions, each element-forming member having an elongated slot extending transversely of said structure into said coupling head portion to impart resiliency to said element-forming member.

2. A slide fastener element construction as defined in claim 1 wherein said element-forming members in each pair are axially displaced relative to each other in the longitudinal direction of said structure.

3. A slide fastener element construction as defined in claim 1 wherein said element-forming member is provided with an elongate slot extending transversely of said structure and aligned in registration with that in the mating member in each pair.

4. A slide fastener element construction as defined in claim 3 wherein said elongate slot has an enlarged portion conforming to the contour of said coupling head portion.

5. A slide fastener element construction as defined in claim 1 wherein said bridge is provided centrally with a cutout recess which defines an axis of fold about which said structure is folded on itself, said recess flaring outwardly to provide a rounded corner on each side thereof.

6. A slide fastener element construction as defined in claim 1 wherein said base portions are each provided with an elongated groove extending the full length of said structure and with longitudinally aligned, spaced-apart apertures in and along said groove.

* * * * *